US008198799B2

(12) United States Patent
Ibuki et al.

(10) Patent No.: US 8,198,799 B2
(45) Date of Patent: Jun. 12, 2012

(54) IMAGE DISPLAY APPARATUS

(75) Inventors: Hiroaki Ibuki, Sagamihara (JP); Masahiro Yokota, Fukaya (JP); Keiji Suzuki, Yokohama (JP); Yoshiyuki Kitahara, Fujisawa (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/172,197

(22) Filed: Jun. 29, 2011

(65) Prior Publication Data

US 2011/0254434 A1 Oct. 20, 2011

Related U.S. Application Data

(62) Division of application No. 11/961,717, filed on Dec. 20, 2007, now Pat. No. 8,018,133.

(30) Foreign Application Priority Data

Dec. 25, 2006 (JP) ..... 2006-348192
Dec. 18, 2007 (JP) ..... 2007-325808

(51) Int. Cl.
*H01J 1/62* (2006.01)
*H01J 63/04* (2006.01)

(52) U.S. Cl. ..... 313/496; 313/495; 313/497

(58) Field of Classification Search ..... 313/495–497
See application file for complete search history.

(56) References Cited

U.S. PATENT DOCUMENTS 5,592,056 A 1/1997 Peyre et al.
6,677,706 B1 1/2004 Hara et al.
6,853,148 B2 2/2005 Yamazaki et al.
7,312,770 B2 12/2007 Onishi
7,400,082 B2 * 7/2008 Suzuki et al. ..... 313/473
7,821,191 B2 10/2010 Takahashi et al.
7,834,535 B2 11/2010 Ibuki et al.
2005/0179398 A1 8/2005 Onishi
2006/0061258 A1 3/2006 Tagawa et al.
2006/0087248 A1 4/2006 Konishi et al.
2006/0091781 A1 5/2006 Haraguchi et al.
2006/0290265 A1 12/2006 Murata
2007/0080646 A1 4/2007 Yokota et al.
2007/0126339 A1 6/2007 Kato et al.
2007/0236131 A1 * 10/2007 Tsunemi et al. ..... 313/495
2007/0236418 A1 * 10/2007 Fan ..... 345/75.2
2008/0012468 A1 * 1/2008 Cho et al. ..... 313/496
2008/0111467 A1 5/2008 Yokota et al.
2008/0157666 A1 7/2008 Date et al.
2008/0174230 A1 * 7/2008 Ibuki et al. ..... 313/496

FOREIGN PATENT DOCUMENTS

EP 1 833 073 A1 9/2007
JP 10-326583 A 12/1998
JP 2006-185701 A 7/2006

* cited by examiner

*Primary Examiner* — Peter MacChiarolo
*Assistant Examiner* — Thomas A Hollweg
(74) *Attorney, Agent, or Firm* — Fitzpatrick, Cella, Harper & Scinto

(57) ABSTRACT

A display apparatus according to the present invention has a plurality of electroconductive layers outside of an image display area. Mutually adjacent ones of the electroconductive layers are electrically connected by a resistor. The resistor has a first region, and a second region which is more separated from the image display area than the first region. The area of the second region per unit length in the direction separating from the image display area is smaller than the area of the first region.

6 Claims, 7 Drawing Sheets

IMAGE DISPLAY APPARATUS

This application is a division of U.S. application Ser. No. 11/961,717, filed Dec. 20, 2007.

BACKGROUND OF THE INVENTION

1. Field of the Invention

The present invention relates to a flat panel type image display apparatus adapted to display an image in such a manner that electrons are made to be emitted from electron-emitting devices provided in a rear substrate, and that phosphor layers provided in a front substrate is excited by the electrons to emit light.

2. Description of the Related Art

In recent years, a field emission display (FED), a display apparatus including surface conduction type electron-emitting devices, and the like, have been known as flat display apparatuses having a vacuum envelope of a flat panel structure.

The FED and the display apparatus including surface conduction type electron-emitting devices have a vacuum envelope in which peripheral portions of front and rear substrates arranged opposite to each other at a predetermined interval via spacers are joined by a rectangular frame-like side wall, and the inside of which is evacuated.

Phosphor layers of three colors and a metal back covering the phosphor layer are formed over the inner surface of the front substrate. On the inner surface of the rear substrate, a number of electron-emitting devices as electron emission sources to make the phosphor layer excited and emit light, are arranged in correspondence with each pixel of the phosphor layer. Further, a getter film is formed over the inner surface of the front substrate in order to maintain a high vacuum inside the vacuum envelope.

A voltage higher by several kilovolts than the voltage of the electron-emitting device is applied to the metal back and the getter film, so that an electron beam emitted from the each electron-emitting device is accelerated by the electric field. Thus, the accelerated electron beam passes through the metal back and the getter film, so as to be irradiated to the corresponding phosphor layer. Thereby, the phosphor is excited and emits light so as to display a color image.

In this way, when the high voltage for accelerating the electron beam is applied between the front substrate and the rear substrate which are arranged close to each other, a problem of discharge often arises. When the discharge is caused, a large current flows through the discharge place to result in a problem that the electron-emitting device in the discharge place is damaged.

As a method for solving such a problem, there is known a technique to reduce the discharge damage by such a way that the metal back covering the phosphor layer of the front substrate is electrically divided into small regions, and the resistance between the divided regions is made high so as to suppress the current flowing at the time of the discharge (see Japanese Patent Laid-Open No. H10-326583). Further, a resistance value of the resistor electrically connected between the divided regions is disclosed in Japanese Patent Laid-Open No. 2006-185701.

There is considered a case of providing an electroconductive layer to which a voltage (anode voltage) for accelerating electrons is applied. Here, the electroconductive layer corresponds to one or both of the metal back and the getter. It is preferred that the metal back layer of the image display area is formed over the entire image display area from a viewpoint of making the luminance of a display image uniform. Further, it is preferred that the getter is uniformly formed over the entire image display area from a viewpoint of maintaining the degree of vacuum and a viewpoint of the uniform service life of the electron source.

The electroconductive layer may be arranged in required regions. However, it is difficult to form the electroconductive layer only in the required regions. For example, the electroconductive layer is formed into a desired shape by vapor deposition using a mask. However, since the mask cannot be brought into close contact with the substrate, it is not possible to set the deposition range of the electroconductive layer which is formed outside the image display area. It is possible to make the electroconductive layer surely formed at least in the region where the electroconductive layer must be arranged, by setting the forming region of the electroconductive layer large. The region where the electroconductive layer must be arranged is the image display area. However, it is difficult to make the electroconductive layer surely formed in the image display area, while preventing the electroconductive layer from being formed outside the image display area. Further, in the case where the electroconductive layer is uniformly formed, a large current flows at the time when a discharge is caused between the electroconductive layer and the rear substrate. Therefore, it is preferred that the electroconductive layer is not provided as one large electroconductive layer, but is provided by being divided into a plurality of electroconductive layers. Here, even when the electroconductive layer is formed outside the image display area, it is also preferred that the electroconductive layer outside the image display area is provided by being divided into a plurality of electroconductive layers. However, there is a problem that when the plurality of electroconductive layers are completely electrically isolated, the potential of the electroconductive layers becomes unstable. Therefore, the present inventors have performed investigation for the purpose of adopting a structure in which the plurality of conductive layers outside the image display area are electrically connected by resistors. Specifically, the present inventors have performed investigation about a structure in which mutually adjacent ones of electroconductive layers are made to overlap with respectively different portions of a common resistor, and to be electrically connected to the resistor. As a result of the investigation, it was found that a specific problem arises when the structure is adopted. The problem will be described below. FIGS. 9A and 9B schematically show contact states of the electroconductive layers and the resistor outside the image display area. FIG. 9A shows an example in which the electroconductive layer formed by vapor deposition is widely diffused. FIG. 9B shows an example in which the diffusion region is not expanded so much. As shown in FIGS. 9A and 9B, when a resistor 160 has a simple rectangle shape, a contact area between the resistor 160 and an electroconductive layer 135 is greatly influenced by the diffusion degree of the electroconductive layer formed by vapor deposition. That is, when the electroconductive layer is formed by being widely diffused as shown in FIG. 9A, it is possible to widely secure the contact area between the resistor 160 and the electroconductive layer 135 as shown by the broken lines. On the other hand, when the electroconductive layer is not so widely diffused as shown in FIG. 9B, the contact area between the resistor 160 and the electroconductive layer 135 is reduced. In this way, the vapor-deposited area outside the image display area is unstable. Thus, in the case where the resistor 160 has the simple rectangle shape, the mutual contact area between the resistor 160 and the electroconductive layer 135 for making the current surely flow from the resistor 160 to the electroconductive layer 135 and vice versa, is greatly influenced by the degree of vapor deposition of the electroconductive layer.

Therefore, an object of the present invention is to provide an image display apparatus in which the overlapping area between the electroconductive layer and the resistor outside the image display area is hardly influenced by the size of the forming region of the electroconductive layer.

SUMMARY OF THE INVENTION

In order to solve the above described problem, an image display apparatus according to the present invention is characterized by including: a front substrate having a plurality of phosphor layers and an electroconductive layer covering the plurality of phosphor layers; and a rear substrate having a plurality of electron-emitting devices for irradiating the plurality of phosphor layers with electrons, and characterized in that the front substrate has a plurality of electroconductive layers arranged outside of an image display area in which the plurality of phosphor layers are disposed on the front substrate, and has a resistor, in that mutually adjacent ones of the plurality of electroconductive layers arranged outside of the image display area overlap with respectively different portions of the resistor, to be electrically connected to the resistor, and in that the resistor has first and second regions arranged such that the image display area is closer to the first region rather than to the second region, and the second region is smaller area than the first region, per unit length in a direction of separating from the image display area.

According to the present invention, it is possible to reduce the influence due to the fact that the forming range of the conductive layer cannot be strictly determined.

Further features of the present invention will become apparent from the following description of exemplary embodiments with reference to the attached drawings.

DESCRIPTION OF THE EMBODIMENTS

In the following, embodiments according to the present invention will be described with reference to the accompanying drawings.

First, a display apparatus including surface conduction type electron-emitting devices will be described as an example of a flat panel type display apparatus according to an embodiment of the present invention.

Figure 1:
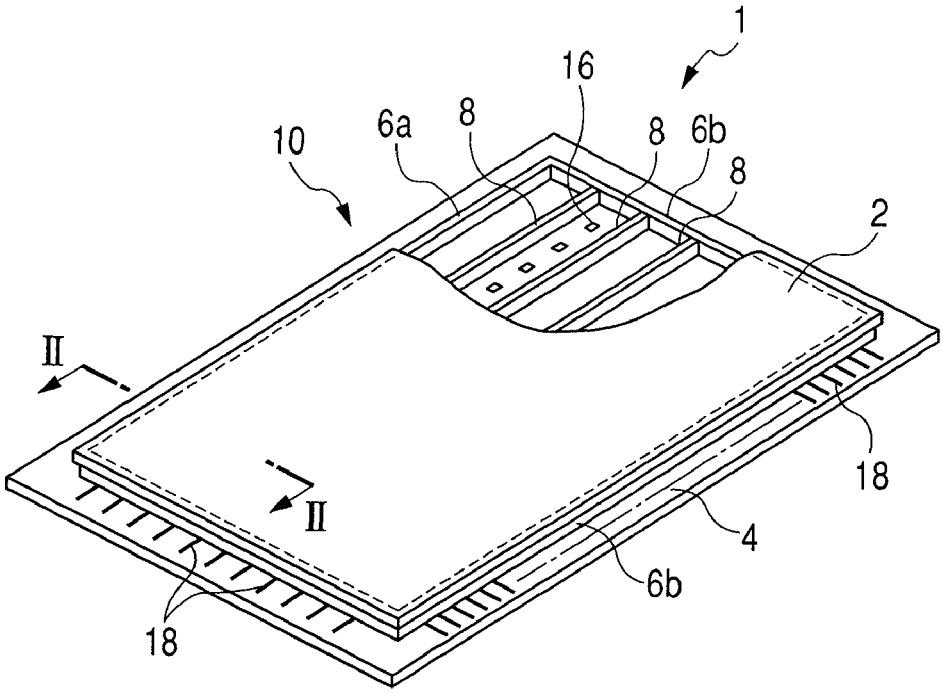
FIG. 1 is a perspective view showing a vacuum envelope of an SED in a state where a front substrate partially cut away.
Figure 2:
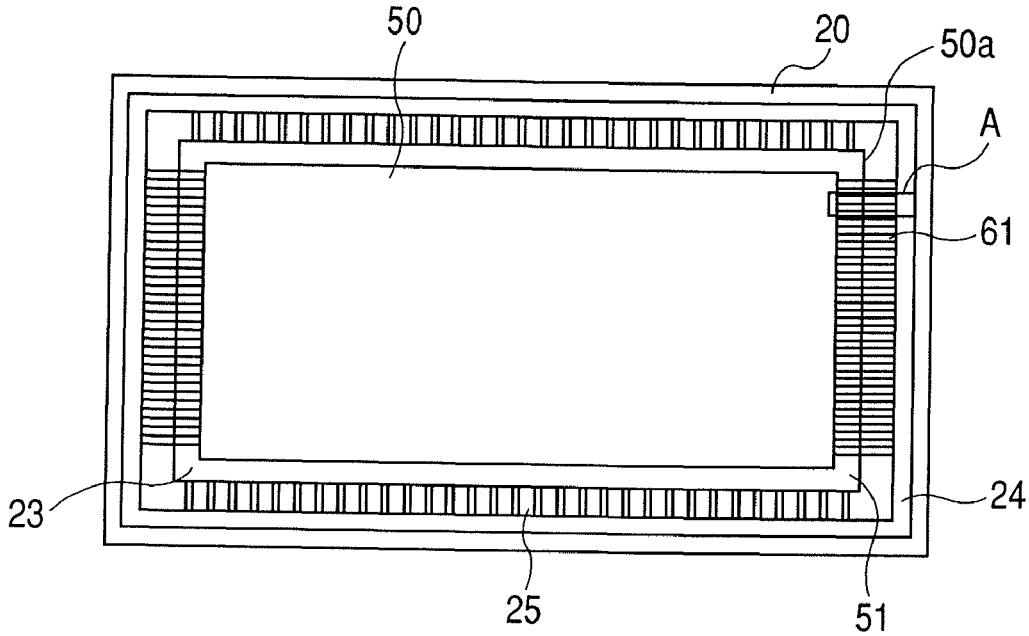
FIG. 2 is a plan view of an example of a front substrate according to the present invention.
Figure 3:
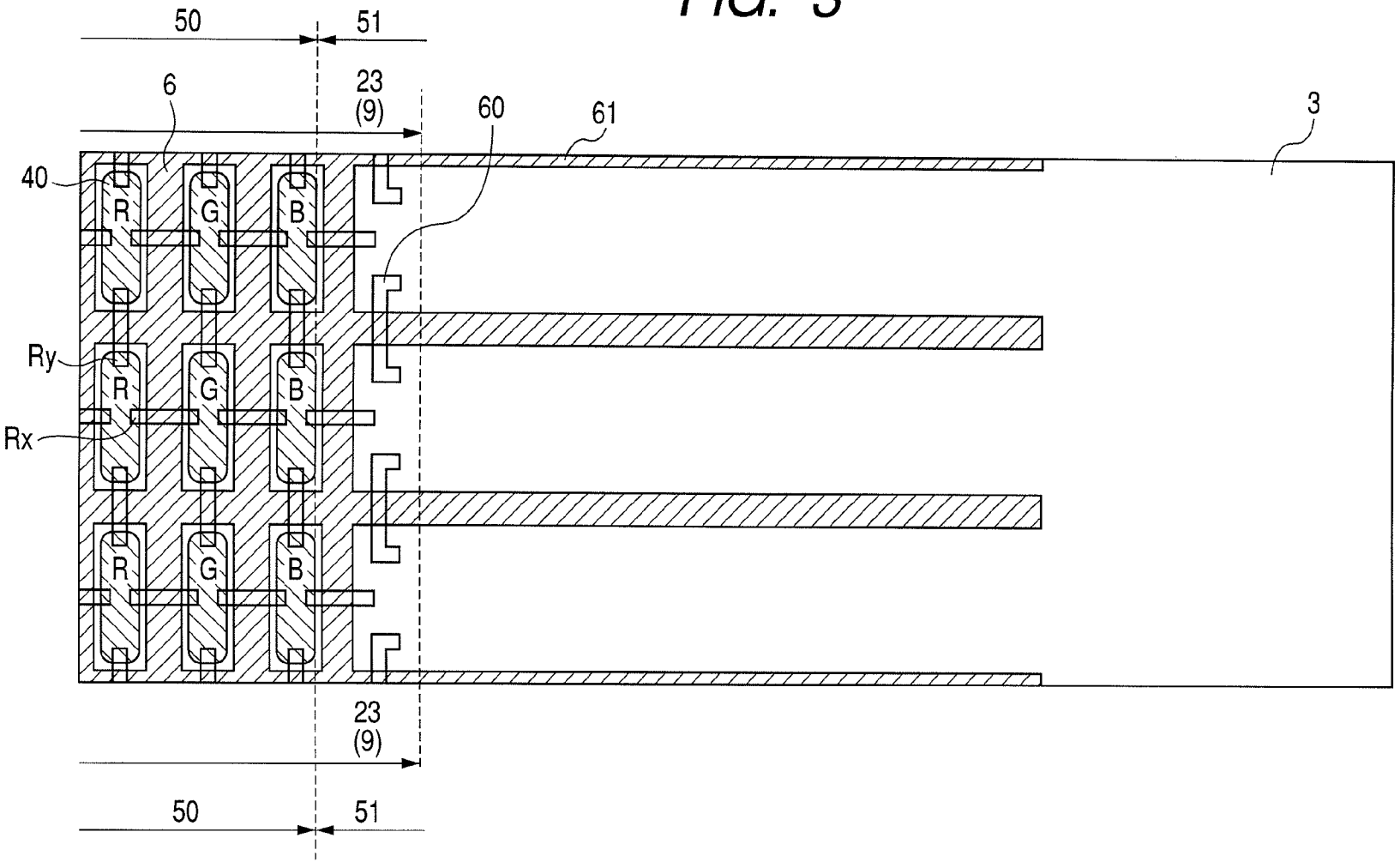
FIG. 3 is a schematic enlarged view of the portion A in FIG. 2.
Figure 4:
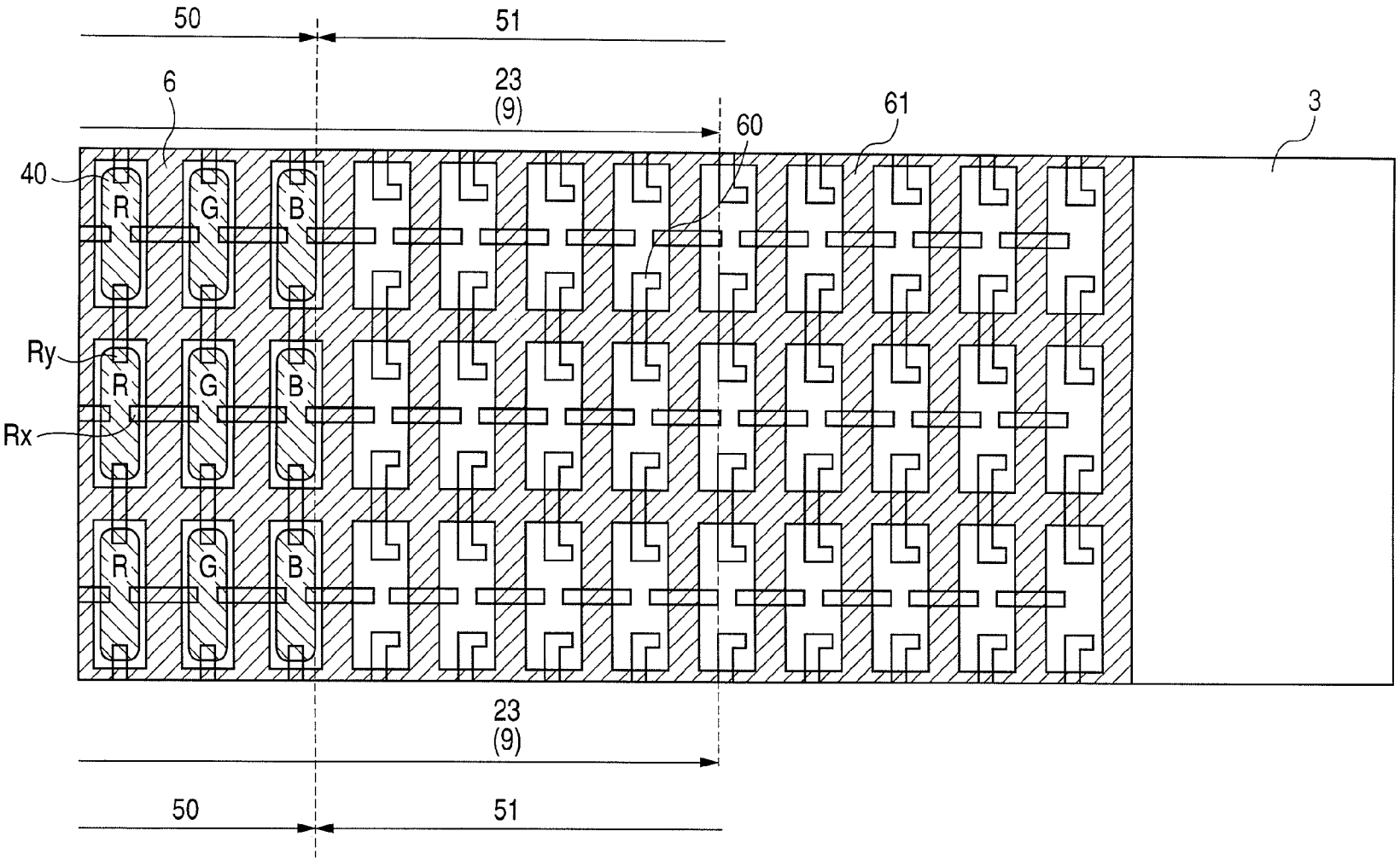
FIG. 4 is a schematic view of another example of the portion A.
Figure 6A:
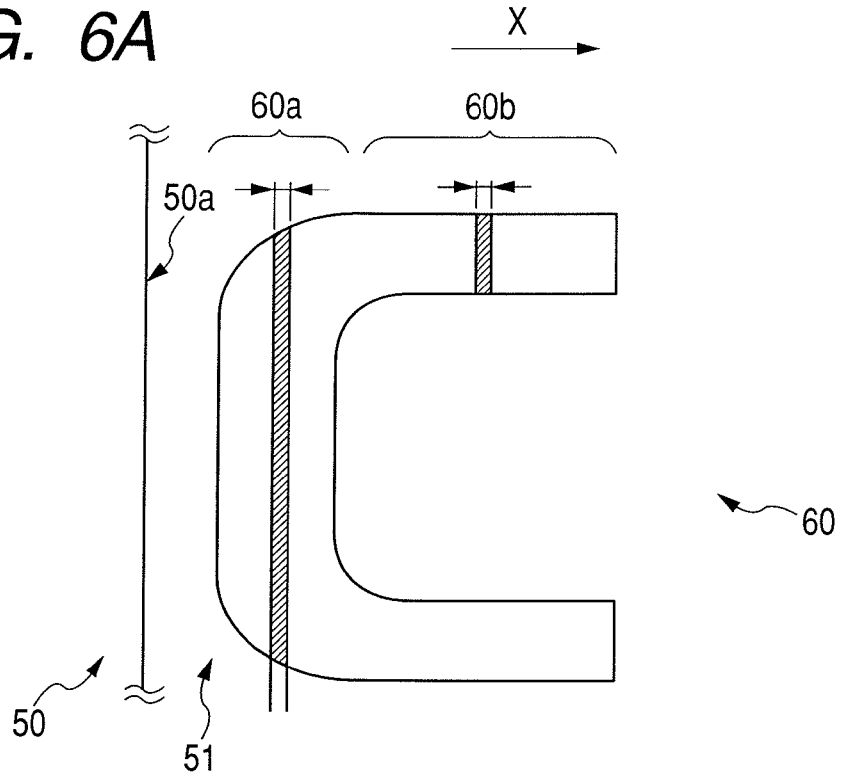
FIGS. 6A and 6B are figures showing an example of a shape of a resistor.
Figure 6B:
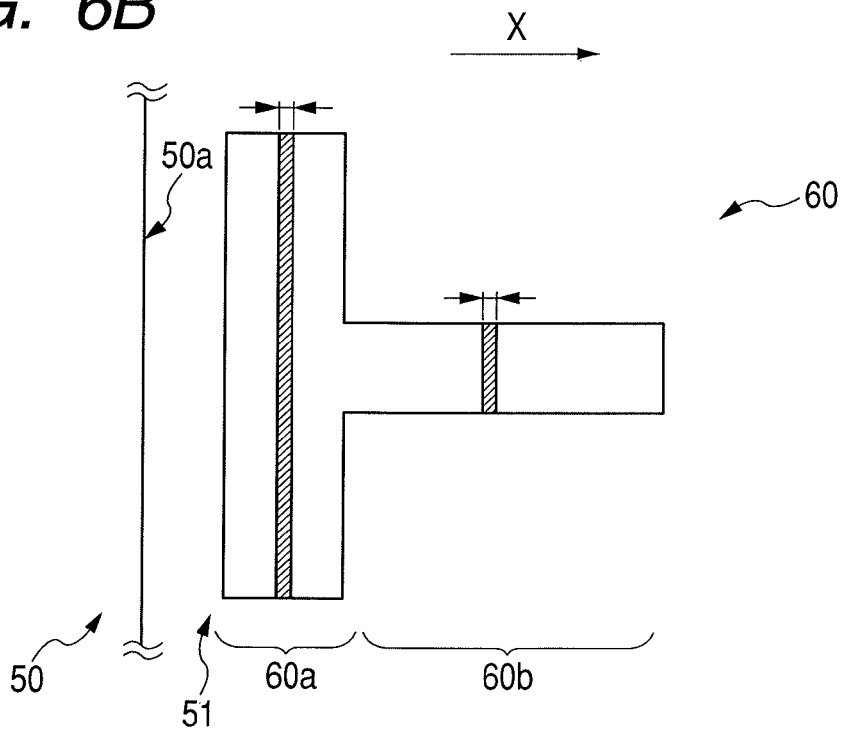
Figure 7A:
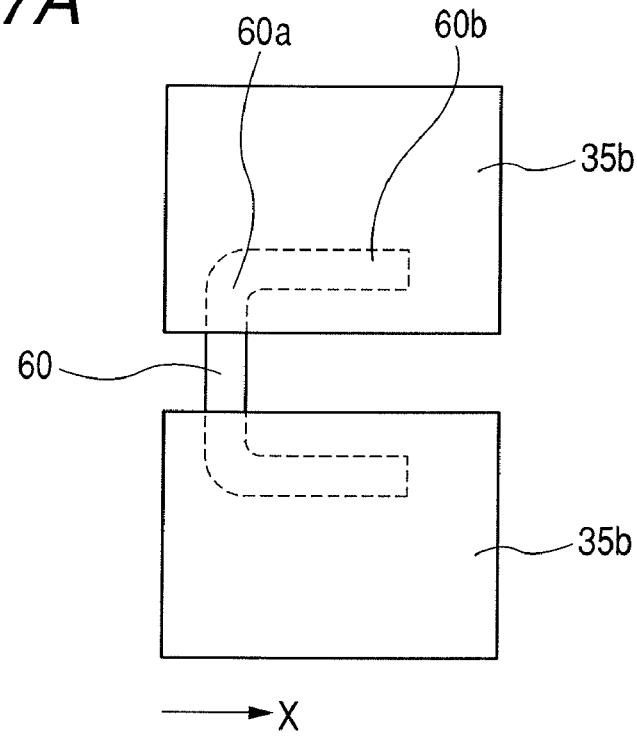
FIGS. 7A and 7B are schematic views showing a contact state of an electroconductive layer and the example of the resistor according to the present invention outside an image display area.
Figure 7B:
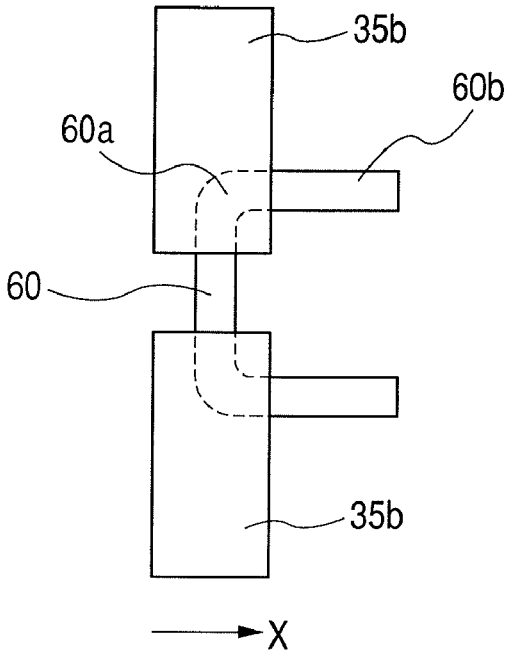

FIG. 1 is a perspective view showing a vacuum envelope of the display apparatus in a state where a front substrate is partially cut away. FIG. 2 is a plan view of the front substrate according to the present embodiment. Note that FIG. 2 shows the front substrate in a manufacturing stage. FIG. 3 is a schematic enlarged view of the portion A in FIG. 2, and FIG. 4 is a schematic view of another example of the portion A. Further, FIG. 4 shows a structure in which in a region extending to the outside of a metal back 23 as an electroconductive layer, an insulation rib 6 is formed in the same shape as the insulation rib of an image display area 50. The metal back 23 in an external region 51 outside the image display area 50 is divided by the insulation rib 6. Here, the phosphor itself is an insulating body, and the existence of the phosphor does not contribute to the division of the metal back. Thus, either of the structures shown in FIG. 5 and FIGS. 6A and 6B may be adopted. FIGS. 7A and 7B show perspective views of the portion A in FIG. 2.

As shown in FIG. 1, a display apparatus 1 includes a front substrate 2 and a rear substrate 4 which are respectively made of a rectangular-shaped glass plate with a thickness of 1 mm to 2 mm, and the substrates are arranged opposite to each other with a gap (about 1.0 mm to 2.0 mm) via spacers 8. Then, the front substrate 2 and the rear substrate 4 are joined at the periphery via a rectangular frame-like side wall 6*b*, so that the inside of the joined substrates forms a vacuum envelope 10. The side wall 6*b* and the front substrate 2 are joined to each other by a sealing material. The side wall 6*b* and the rear substrate 4 are also joined to each other by the sealing material. On the inner surface of the rear substrate 4, there are provided a number of surface conduction type electron-emitting devices 16 which emit electrons for making phosphor layers provided over the front substrate layer excited to emit light. The electron-emitting devices 16 are arranged in a plurality of rows and a plurality of columns in correspondence with each pixel, and are respectively formed by an electron emitting portion, a pair of element electrodes for applying a voltage to the electron emitting portion (both not shown), and the like. Further, on the inner surface of the rear substrate 4, a number of wirings 18 for applying drive voltages to the respective electron-emitting devices 16 are provided in a matrix form, and the ends of the wirings are lead out to the outside of the vacuum envelope 10.

Note that the front substrates 2 and the rear substrate 4 are degassed and baked in a vacuum atmosphere, and thereafter the substrates are sealed to each other with the side wall 6*b* sandwiched therebetween, so as to form the vacuum envelope 10. Prior to the sealing, a getter layer is formed over the entire inner surface of the front substrate 2 in the vacuum atmosphere, so that the high vacuum can be maintained after the formation of the panel.

When an image is displayed in the display apparatus 1, a voltage is applied between the element electrodes of the electron-emitting device 16 via the wirings 18, to enable an electron beam to be emitted from the electron emitting portion of an arbitrary one of the electron-emitting devices 16. At the same time, the electron beam is accelerated by an anode voltage applied to the image display area 50, so as to be irradiated to a phosphor screen 12. Thereby, a desired phosphor layer 5 is excited and emits light so as to display the image.

FIG. 2 is a figure showing a structure of the front substrate. The metal back 23 as an electroconductive layer and the insulation rib are formed in the image display area 50 which is a region to envelop the outer edge of the phosphor layer formed in the front substrate. The metal back 23 is also formed outside the image display area. A common electrode 24 for supplying the anode voltage to the electroconductive layer in the image display area is arranged along the sides of the front substrate. Connecting resistors 25 are connected between the electroconductive layer in the image display area and the common electrode 24.

An external region 51 outside of the image display area 50 is formed between the image display area 50 and the common electrode 24.

FIG. 3 is an enlarged schematic view of the portion A in FIG. 2. The image display area 50 for displaying an image is formed on the inner surface of the front substrate 2. The image display area is an area defined by enveloping the outer edge of the phosphor layer. A black carbon-based light shielding layer 3 is formed in a region of the inner surface of the front substrate, from which region light from the phosphor layer need not be taken out to the outside. The insulation rib 6 is formed so as to surround each phosphor 40. Further, in the image display area 50, resistors Rx are formed in the lateral direction, and resistors Ry are formed in the longitudinal direction. The insulation rib 6 has a reversely tapered side surface in which the upper surface is wider than the lower surface formed so as to surround each phosphor 40. The insulation rib 6 has recessions and projections enough to divide an electroconductive layer 35*a* formed by vapor deposition of aluminum or the like. The resistor Rx and the resistor Ry are also formed by vapor deposition, and arranged so as to pass under the insulation rib 6 between the phosphors 40. The electroconductive layer 35*a* which is the metal back 23 or the getter is collectively vapor-deposited, but is broken at steps formed by the insulation rib 6 to thereby be formed into a plurality of electroconductive layers. The electroconductive layers are also formed over the respective portions where the resistors Rx and Ry are exposed, and hence the adjacent electroconductive layers are electrically connected by the resistor Rx and the resistor Ry. In this way, the electroconductive layer 35*a* of the image display area 50 has a structure in which even when a discharge is caused in the image display area 50, the current flowing through the discharge place is restricted so as to reduce the discharge damage. Note that in FIG. 3, a plurality of layers are laminated as described above, but a part of the layers are transparently illustrated so as to make it easy to understand the structure.

In the front substrate 2 according to the present invention, an electroconductive layer 35*b* is also formed in the external region 51 outside of the image display area 50 at the same time, in order to surely form the electroconductive layer 35*a* in the image display area 50. Needle-like ribs 61 having the same cross-sectional structure as that of the insulation rib 6 are formed in the external region 51 out side of the image display area 50. The electroconductive layer 35*b* of the external region 51 outside of the image display area 50 is divided by the elongated needle-like ribs 61 so as to be formed into a plurality of electroconductive layers. The needle-like rib 61 is connected to the insulation rib 6 in the image display area 50, and is extended sufficiently longer than an electroconductive layer forming area 9 formed in a sufficiently large range as compared with the image display area 50.

The adjacent electroconductive layers 35*b* are electrically connected by resistors 60. Here, the shape of the resistor 60 is described with reference to FIGS. 6A, 6B, 7A and 7B. FIG. 6A shows an example of a resistor having a U shape according to the present invention. FIG. 6B shows another example of a resistor having a T shape according to the present invention. FIGS. 7A and 7B are schematic views showing a contact state between the resistor having the shape shown in FIG. 6A and the conductive layer in the external region 51 of the image display area 50. FIG. 7A shows a case where the conductive layer is formed so as to be widely diffused. FIG. 7B shows a case where the conductive layer is formed so as not to be expanded so much.

As shown in FIG. 6A, the resistor 60 has a first region 60*a*, and a second region 60*b* which is arranged to be more separated from the image display area 50 than the first region 60*a*. The first region 60*a* is formed so as to extend in the direction along an outer edge 50*a* of the image display area 50. Further, the second region 60*b* is formed so as to extend in the direction (the normal direction of the outer edge of the image display area) crossing the direction along which the first region 60*a* extends. In the resistor 60, the area per unit length in the X direction toward the outside from the image display area 50 is smaller than the area near the image display area 50. That is, as for the first region 60*a* and the second region 60*b*, the resistor 60 is formed such that the area per unit length in the X direction in the second region 60*b* is smaller than the area in the first region 60*a* (see hatching portions in the figure).

FIG. 7A shows the divided electroconductive layers 35*b*. FIG. 7A schematically shows the electroconductive layer 35*b* which is formed so as to extend in the direction of separating from the image display area 50. When the electroconductive layer 35*b* is formed in such a large range, all the first region 60*a* (except the region between the divided conductive layers 35*b*) and all the second region 60*b* of the resistor 60 are covered by the electroconductive layer 35*b*. In this way, in addition to the first region 60*a*, all the second region 60*b* is covered by the electroconductive layer 35*b*, so that the contact area between the resistor 60 and the electroconductive layer 35*b* can be widely secured.

On the other hand, FIG. 7B also shows the divided electroconductive layer 35*b*. However, FIG. 7B schematically shows the electroconductive layer 35*b* formed to be not so wide in the X direction as compared with FIG. 7A. In this way, when the vapor deposition region is not extended so much, all the second region 60*b* is not covered by the electroconductive layer 35*b*, and only a part of the second region 60*b* is covered. However, even in this case, all the first region 60*a* is covered by the electroconductive layer 35*b* except the region located between the divided conductive layers 35*b*, and a part of the second region 60*b* is also covered. For this reason, it is possible to secure a desired contact area between the resistor 60 and the electroconductive layer 35*b*.

Here, when the contact area between the resistor 60 and the electroconductive layer 35*b* in the case of FIG. 7A is compared with that in the case of FIG. 7B, the contact area in the case of FIG. 7B is reduced so that a difference in the contact area is caused between the both cases. However, in the case of FIG. 7B, the contact area is reduced as compared with the case of FIG. 7A, but the area per unit length in the X direction is small in the second region 60*b*. For this reason, even in the case of FIG. 7B, the contact area is not significantly reduced as compared with the case of FIG. 7A, and hence it is possible to reduce the difference in the contact area between both the cases.

That is, according to the resistor 60 of the present embodiment, the influence of extension degree of the conductive layer 35*b* formed by vapor deposition is suppressed to be small, and at the same time, it is possible to secure a wide contact area between the electroconductive layer 35*b* of the image display area 50 and the resistor 60. For this reason, with the resistor 60 according to the present embodiment, it is possible to provide desired discharge resistance to the divided electroconductive layer in the external region 51 outside of the image display area 50.

Note that the shape of the resistor 60 may be, for example, the shape as shown in FIG. 6B, other than the shape as shown in FIG. 6A. Also in the shape shown in FIG. 6B, when the first region 60*a* is compared with the second region 60*b* which is more separated from the image display area 50 than the first region 60*a*, the area per unit length of the second region 60*b* in the X direction is smaller than that of the first region 60*a*. Further, the first region 60*a* is formed so as to extend in the direction along the outer edge 50*a* of the image display area 50. On the other hand, the second region 60*b* is formed to extend in a direction crossing the direction along which the first region 60*a* extends. That is, the resistor 60 shown in FIG. 6B has the same effect as that of the resistor shown in FIG. 6A.

As described above, in the image display apparatus according to the present invention, the area per unit length in the second region of the resistor for connecting the mutually adjacent electroconductive layers in the external region outside of the image display area 50 is smaller than the area per unit length in the first region of the resistor. By forming the resistor into such shape, it is possible to secure the contact area between the electroconductive layer and the resistor, and at the same time, to reduce the influence caused by the fact that vapor deposition range of the electroconductive layer is not defined.

EXAMPLE

Example 1

In the following, the embodiments according to the present invention will be described by means of specific examples and with reference to FIG. 2 to FIG. 5.

The light shielding layer 3 is formed as the lowermost layer on substantially the entire front substrate 2. Over the light shielding layer 3, there are formed the image display area 50, the metal back 23 which is formed so as to be greater by about several millimeters than the image display area 50, the common electrode 24 surrounding the periphery of the metal back 23, and the connecting resistor 25 which electrically connects metal back 23 and common electrode 24. The connecting resistors 25 are arranged in the same number as the number of the pixels of the image display area 50. Note that in the region where the metal back 23 is formed, the region formed to be larger by about several millimeters than the image display area 50 is the external region 51 outside of the image display area 50.

Figure 5:
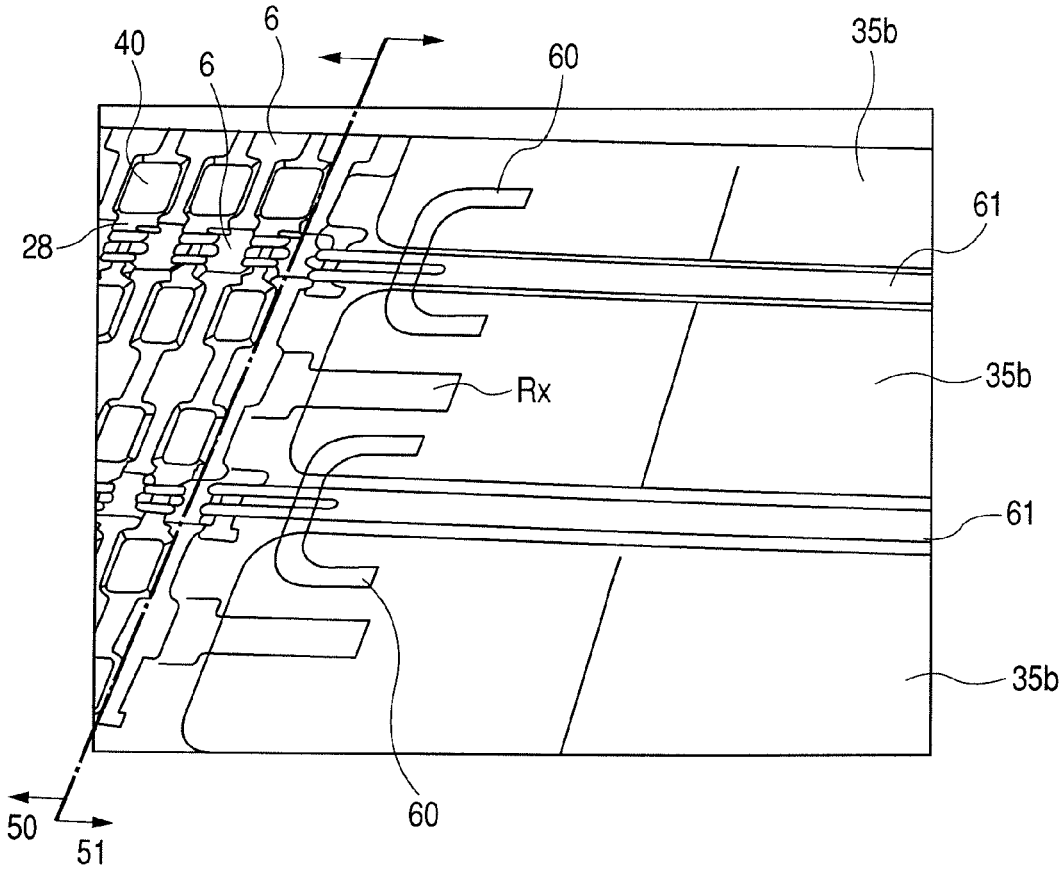
FIG. 5 is a perspective view of the portion A.

In the image display area shown in FIG. 3 and FIG. 4, the phosphor 40 is separated in the first layer by the insulation rib whose upper surface is formed in a shape of recessions and projections. In FIG. 5, structures other than the phosphor 40 are formed into a rib in which the upper surface is wider than the lower surface having a thickness of about 10 to 20 μm. The rib has a two-layer structure in which the first layer is formed by $TiO_2$ based resistors Rx and Ry and $TiO_2$ based insulation ribs 6, which surround the phosphor 40. In the second layer, an insulation rib made of the same material as the insulation rib of the first layer is formed so as to be the shadow portion of the first layer, and divides the electroconductive layer.

In the external region 51 outside of the image display area 50, there exist needle-like ribs 61, the resistors Rx, the resistors 60, and the electroconductive layer 35*b*. The electroconductive layer 35*b* of the external region 51 out side of the image display area 50 is divided by the step caused by the needle-like rib 61. Therefore, one of the electroconductive layers 35*b* is surrounded by the needle-like rib 61 and the insulation rib 6. Further the mutually adjacent electroconductive layers 35*b* are electrically joined by the resistor 60 in the longitudinal direction in FIG. 3. Further, the conductive layer 35*b* and the electroconductive layer in the image display area are electrically joined by the resistor Rx. The needle-like rib 61 is formed simultaneously with the insulation rib 6 of the first and second layers. The resistor Rx is a resistor extending from the image display area 50. The resistor 60 having, as described above, the first region 60*a* and the second region 60*b*, is formed to be inserted into the interval of the insulation rib of the first layer, and to be straddled by the insulation rib of the second layer. The conductive layer 35*b* is formed of an Mn based thin film, which is formed so as to avoid the needle-like rib 61 and to override the resistor Rx and the resistor 60.

Here, in the image display area 50, the resistor Rx was formed to be 50 kΩ, and the resistor Ry was formed to be 400 kΩ. In the external region 51 outside of the image display area, the resistor Rx of the external region 51 outside of the image display area 50 was formed to be 50 kΩ, and the resistor 60 was formed to be about 200 kΩ. As a result, it was possible to form the peripheral structure capable of obtaining constant discharge resistance irrespective of the deposition range variation of the electroconductive layer 35*b*.

Example 2

Figure 8:
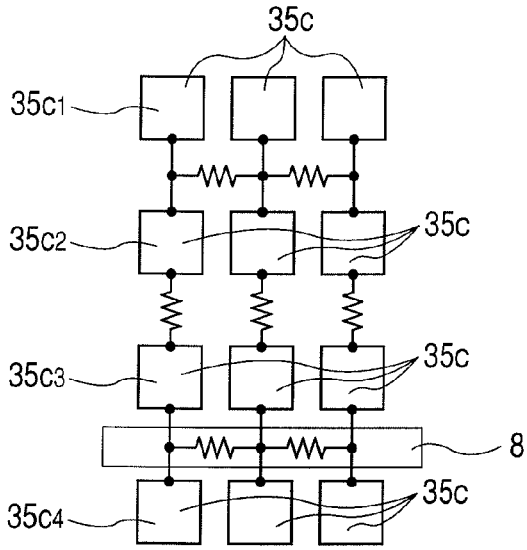
FIG. 8 is a figure illustrating a division pitch of the electroconductive layer in the image display area, and a wiring structure of the resistor.
Figure 9A:
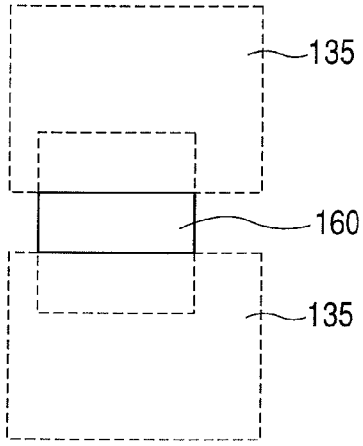
FIGS. 9A and 9B are schematic views showing a contact state of the electroconductive layer and the resistor having a simple rectangle shape outside the image display area.
Figure 9B:
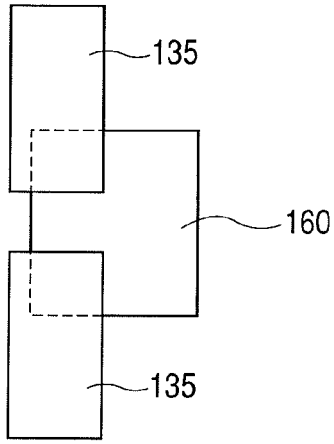

In the present embodiment, the structure of the external region 51 outside of the image display area 50 is the same as that of example 1, but the structure in the image display area is different. That is, an electroconductive layer 35*c* provided over each phosphor as shown in FIG. 8 is not divided by one pixel pitch in the direction (scanning line direction) in which scanning lines are arranged side by side, but is divided by two-pixel pitch. In FIG. 8, the electroconductive layer 35*c* provided over the each phosphor is independently illustrated, respectively, in order to make it easy to understand the electrical connection relation, but the conductive layer 35*c*1 and the conductive layer 35*c*2 are structurally integrated with each other. Further, the conductive layer 35*c*3 and the conductive layer 35*c*4 are also structurally integrated with each other. On the other hand, the conductive layer 35*c*2 and the conductive layer 35*c*3 are divided from each other. The divided portions are connected via the resistor. The division in the direction (the direction along which the scanning line extends) perpendicular to the scanning line direction is performed at one pixel pitch. The divided electroconductive layers 35*c* are connected via the resistor. The resistors Rx for connecting between the metal backs as the electroconductive layers 35*c* in the lateral direction, and the resistors Ry for connecting between the metal backs in the longitudinal direction, are arranged under the metal backs. In the present example, common electrodes are arranged at the upper and lower positions. In the case of the present example, when the anode voltage is set as V, the scanning line direction division number (the number of electroconductive layers) is set as n, and the emission current is set as I, then the resistance value R of the resistors Rx and Ry are set so as to satisfy the relation: $0.3\ V > nRI$.

When the anode voltage is set as V=10 kV, the scanning line direction division number is set as n=540, and the emission current is set as I=5 μA, then Ry is set as Ry=600 kΩ, because R<1.1 MΩ. In view of the voltage generated at the time of discharge, Rx is set as Rx=300 kΩ. Note that the resistor which connects between the common electrode and the outermost metal back is set to 10 MΩ. Next, a method for manufacturing the present example will be described. A BM is formed on a glass substrate by lithography. Then, phosphors of respective colors are formed by printing. Next, a resistor material (ATO coated $TiO_2$ based material) is formed by printing. Next, an aluminum film is formed by vapor deposition. Thereafter, the metal back is divided by photolithography and wet etching.

When the discharge current was measured in the above described constitution, the discharge current was reduced to 0.2 A at the anode voltage set as V=10 kV, without the divided portions being subjected to a dielectric breakdown and becoming electrically conducted. When such division is not performed, the discharge current reached a level of 100 A. Thereby, it was found that a significant effect of reducing the discharge current can be obtained by adopting the structure of the present example. Further, when the decrease in luminance due to the driving was investigated, the decrease in luminance due to the potential drop in the metal back was reduced to 3% or less, which is the level that could be hardly detected. Further, in this structure, the metal back is cut for every two pixels in the longitudinal direction, and hence it is possible to bring the metal back into tight contact with the Rx. As a result, adhesive force of the metal back is improved, so that the peeling due to Coulomb force is significantly reduced as compared with the case where the metal back is cut for each pixel. Further, by cutting the metal back for every two or more pixels in the scanning line direction, the number of divisions in the scanning line direction is reduced, and the potential decrease in the metal back due to the emission current is suppressed.

Further, the present inventors also similarly investigated the case where the common electrode is provided only on the upper one side of the pixel.

In this case, the resistance values of the resistors Rx and Ry were set to satisfy the relation: 0.1>nRI. When the anode voltage was set as V=10 kV, the scanning line direction division number was set as n=540, and the emission current was set as I=5 μA, then the resistance value R of the resistor Ry was set as R=200 kΩ because R<370 kΩ. Further, the resistance value R of the resistor Rx was set to 200 kΩ, and the resistance value of the resistor connecting the outermost pixel to the common electrode was set to 10 MΩ. When the measurement of the discharge current was also similarly performed in this case, the discharge current was 0.3 A. Further, the decrease in luminance was also reduced to the level that could be hardly detected.

Further, the spacer 8 for withstanding the atmospheric pressure was arranged on the resistor Rx. Since the portion of the resistor Ry is formed into a projecting and recessed shape, the shape may be deformed by the pressure of the spacer to generate particles. The resistor Rx is formed to be flat in the scanning line direction, and hence the above described problem can be avoided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-348192, filed Dec. 25, 2006, and 2007-325808, filed Dec. 18, 2007, which are hereby incorporated by reference herein in their entirety.

What is claimed is:

1. An image display apparatus comprising:

a front substrate having a plurality of phosphor layers and a plurality of electroconductive layers arranged above the plurality of phosphor layers; and a rear substrate having a plurality of electron-emitting devices for irradiating the plurality of phosphor layers with electrons, wherein the front substrate has a resistor arranged outside of an image display area in which the plurality of phosphor layers are disposed on the front substrate, mutually adjacent electroconductive layers, among the plurality of electroconductive layers, arranged outside of the image display area, overlap with respectively different portions of the resistor so that said mutually adjacent electroconductive layers are electrically connected to each other via the resistor, and wherein the resistor has a first region and a plurality of second regions arranged such that the image display area is closer to the first region rather than to the second regions, and at least one of the second regions has a smaller area than that of the first region, per unit length in a direction of increasing a distance from the image display area, and the resistor is arranged to be overlapped with the electroconductive layer at every one of the second regions.

2. The image display apparatus according to claim 1, wherein the first region extends in a direction along an outer edge of the image display area, and the first and second regions are formed such that each second region extends in a direction crossing a direction along which the first region extends.

3. The image display apparatus according to claim 1, wherein mutually adjacent electroconductive layers, among the plurality of electroconductive layers, arranged inside of the image display area, are electrically connected through a resistor arranged inside of the image display area.

4. The image display apparatus according to claim 1, wherein one of the plurality of electroconductive layers inside of the image display area is arranged along a direction of a scanning line, in a pitch of two pixels in the direction of the scanning line, and wherein another of the plurality of electroconductive layers inside of the image display area is arranged along a direction perpendicular to the direction of the scanning line, in a pitch of one pixel in the direction perpendicular to the direction of the scanning line.

5. The image display apparatus according to claim 4, further comprising:

common electrodes for applying an anode voltage to the plurality of electroconductive layers inside of the image display area; and a resistor for connecting mutually adjacent electroconductive layers, among the plurality of electroconductive layers, arranged inside of the image display area, wherein the common electrodes are disposed at both sides of the image display area, a number of the electroconductive layers arranged in the scanning line inside of the image display area is n, a resistance of the resistor connecting the mutually adjacent electroconductive layers among the plurality of electroconductive layers, arranged inside of the image display area is R, a current injected into one pixel is I and an anode voltage is V, and a relationship 0.3 V>nRI is satisfied.

6. The image display apparatus according to claim 4, further comprising:

a common electrode for applying an anode voltage to the plurality of electroconductive layers inside of the image display area; and a resistor for connecting mutually adjacent electroconductive layers, among the plurality of electroconductive layers, arranged inside of the image display area, wherein the common electrode is disposed at one side of the image display area, a number of the electroconductive layers arranged in the scanning line inside of the image display area is n, a resistance of the resistor connecting the mutually adjacent ones of the plurality of electroconductive layers arranged inside of the image display area is R, a current injected into one pixel is I, and an anode voltage is V, and a relationship $0.1\ V>nRI$ is satisfied.

* * * * *